US012650248B2

(12) United States Patent
Langaas et al.

(10) Patent No.: US 12,650,248 B2
(45) Date of Patent: Jun. 9, 2026

(54) COLD STORAGE AND A METHOD OF OPERATING A COLD STORAGE

(71) Applicant: LOWENCO A/S, Vamdrup (DK)

(72) Inventors: Kim Langaas, Vamdrup (DK); Soren Maarsso, Vamdrup (DK); Marius Adrian Bararu, Vamdrup (DK)

(73) Assignee: LOWENCO A/S, Vamdrup (DK)

( * ) Notice: Subject to any disclaimer, the term of this patent is extended or adjusted under 35 U.S.C. 154(b) by 218 days.

(21) Appl. No.: 18/264,012

(22) PCT Filed: Feb. 4, 2022

(86) PCT No.: PCT/EP2022/052729
§ 371 (c)(1),
(2) Date: Aug. 2, 2023

(87) PCT Pub. No.: WO2022/167590
PCT Pub. Date: Aug. 11, 2022

(65) Prior Publication Data

US 2024/0118002 A1 Apr. 11, 2024

(30) Foreign Application Priority Data

Feb. 4, 2021 (EP) ..... 21155225

(51) Int. Cl.
*F25D 19/04* (2006.01)
*F25B 7/00* (2006.01)
*F25D 17/06* (2006.01)

(52) U.S. Cl.
CPC ..... *F25B 7/00* (2013.01); *F25D 17/067* (2013.01); *F25D 19/04* (2013.01); *F25B 2400/06* (2013.01); *F25D 2600/02* (2013.01)

(58) Field of Classification Search
CPC ..... F25B 2400/06; F25D 21/06; F25D 17/04; F25D 17/06; F25D 17/067;
(Continued)

(56) References Cited

U.S. PATENT DOCUMENTS 5,584,191 A 12/1996 Kwon
2002/0088238 A1* 7/2002 Holmes ..... F25D 29/00 62/155
(Continued)

FOREIGN PATENT DOCUMENTS

CN 204345961 U 5/2015
CN 108151348 A 6/2018
(Continued)

OTHER PUBLICATIONS

Extended European Search Report from corresponding European Patent Application No. EP21155225.2, Oct. 22, 2021.
(Continued)

*Primary Examiner* — Jerry-Daryl Fletcher
*Assistant Examiner* — Daniel C Comings
(74) *Attorney, Agent, or Firm* — Workman Nydegger

(57) ABSTRACT

A cold storage and a method of operating a cold storage having first cooling unit arranged to cool a compartment and a second cooling unit arranged ensure fast freezing of a substance stored in the compartment. The second cooling unit is operable according to a first, second and third modes of operation involving no, partly, or full contribution from the second cooling unit, wherein shifting between the different modes is determined based on a transition between three different temperature profiles in the compartment.

15 Claims, 5 Drawing Sheets

(58) Field of Classification Search
CPC ..... F25D 2600/02; F25D 2600/06; F25D 2700/12; F25D 19/04
See application file for complete search history.

(56) References Cited

U.S. PATENT DOCUMENTS

| | | | | |
|---|---|---|---|---|
| 2005/0193760 | A1* | 9/2005 | Moran | G01K 11/06 374/E11.006 |
| 2010/0107659 | A1* | 5/2010 | Hildreth, Jr. | F25B 5/02 62/149 |
| 2015/0120597 | A1* | 4/2015 | Dertadian | F25D 3/08 705/332 |
| 2017/0159990 | A1* | 6/2017 | Kim | F25D 11/022 |
| 2019/0242606 | A1* | 8/2019 | Chen | F24F 11/46 |
| 2019/0301781 | A1* | 10/2019 | Dheenadayalan | F25D 29/001 |
| 2020/0393880 | A1* | 12/2020 | Klinge | B60P 3/205 |
| 2022/0087446 | A1* | 3/2022 | Friend | F25D 19/02 |

FOREIGN PATENT DOCUMENTS

| | | | |
|---|---|---|---|
| CN | 110160306 | A | 8/2019 |
| KR | 20110094266 | A | 8/2011 |
| KR | 20150146212 | A | 12/2015 |
| WO | 2006067735 | A1 | 6/2006 |

OTHER PUBLICATIONS

International Search Report from corresponding PCT Application No. PCT/EP2022/052729, Aug. 19, 2022.

* cited by examiner

COLD STORAGE AND A METHOD OF OPERATING A COLD STORAGE

INTRODUCTION

The disclosure relates to a cold storage and a method of operating a cold storage comprising a compartment which is cooled. Particularly, the disclosure relates to a method of operating a cold storage for ultralow-temperature down to e.g. minus 115° C.

BACKGROUND

Traditionally cold storages for ultralow-temperature comprise a compartment with highly insulated walls and include a refrigeration system for reducing the temperature in the compartment. Typically, the cooling system is a vapor-compression refrigeration system with a refrigerant being circulated through a condenser and an evaporator.

It is an object of existing cold storages to obtain a uniform temperature in the compartment. U.S. Pat. No. 5,584,191 discloses a conventional refrigerator with a fan which circulates cold air from an air duct. The duct controls a quantity of the cold air which is flowing into the storage space and the air is introduced into different places of the space. Also, WO2006/067735 discloses a cooling device with a fan blowing cold air around the evaporator to the compartment being cooled.

SUMMARY

It is an object of the disclosure to improve protection of valuable substances being contained in the compartment and particularly to reduce risk of malfunctioning potentially leading to lack of cooling and additionally to increase the cooling efficiency particularly related to the time necessary to solidify a substance stored in the compartment. It is a further object to facilitate economic, efficient, and safe operation, and to ensure lowest freezing time of a substance in the compartment.

For this and other objects, the disclosure provides a cold storage and a method of operating a cold storage.

In a first aspect the disclosure provides a method of operating a cold storage, particularly for ultralow-temperature, comprising a compartment, a first cooling unit comprising a first circuit for circulating a first refrigerant between a first compressor unit, a first condenser, and a first evaporator.

The cold storage further comprises a second cooling unit comprising a second circuit for circulating a second refrigerant between a second compressor unit, a second condenser, and a second evaporator.

Both the first cooling unit and the second cooling unit are arranged to cool the same compartment, and the cooling effect of both units therefore influence the temperature of the same space.

The cold storage further comprises a controller or a control algorithm configured for operating the first and second cooling units according to a first, a second, or a third mode of operation, the first mode providing use of only the first cooling unit, the second mode of operation providing use of the first cooling unit and a part of the second cooling unit, and the third mode of operation provides use of the first cooling unit and the second cooling unit.

The Method of the First Aspect Comprises:

operating the cold storage in the first mode of operation including use of the first cooling unit for reducing temperature in the compartment;

identifying a transition between a first temperature profile and a second temperature profile in the compartment; and initiating the second mode of operation or the third mode of operation at a point in time determined based on the identification of the transition, e.g. upon reaching the transition between the first temperature profile and the second temperature profile in the compartment.

The compressor unit may include one or more compressors. The compressor unit may be arranged in different configurations, e.g. in parallel, in different stages, cascade, etc. or in combinations of the mentioned configurations.

Herein, the term "use of the first cooling unit" or "use of the second cooling unit" means that the respective cooling unit is actively participating in cooling of the compartment. This could be when the respective one of the first and second compressors is turned on, or when the refrigerant is directed into the respective evaporator—i.e. controlled e.g. by a valve arranged to control flow of the refrigerant into the evaporator.

The temperature profiles may particularly express change in temperature as a function of time:

$$R=T(t)$$

A substance in the compartment is generally changing phase at constant temperature meaning that a temperature change during phase change only happens in rare situations, including if there is a flow resulting in a pressure drop resulting in a pressure change equivalent with a temperature change, or if phase change occurs with varying temperature when a zeotropic substance is used.

The substance is cooled by use of a cooling medium, i.e. by use of the air flowing in the compartment. When the temperature in the compartment is reduced, the temperature of the substance $T_s$, is typically higher than the temperature of the air $T_a$, The air may change temperature initially, but after a certain time, right after the phase change begins the temperature of the air will change less or even may be almost constant.

The transition between the first temperature profile and the second temperature profile could be determined in different ways, e.g. analytically, e.g. by recording the air temperature, $T_a$ in the compartment in time.

As an alternative to the analytic process, the transition between the first temperature profile and the second temperature profile could be determined based on knowledge about the substance in the compartment, particularly knowledge related to a phase change temperature of the substance.

The transition may be directly linked to the temperature where the substance in the compartment changes phase.

In one example, the transition could be defined at that temperature where the phase change occurs, and in another example, the transition is not necessarily equal to the temperature where the substance changes phase but depends thereon. The transition may, as an example be found by use of a model, e.g. a table or a mathematical expression determining a transition based on the temperature where the substance changes phase.

If the substance change phase e.g. at minus 50° C. (air temperature Ta), then this temperature, or a temperature calculated based on this temperature, can be used as the transition between the two temperature profiles.

The analytical method of determining the transition may be carried out in different ways.

In one example, a rate by which R changes, i.e.

$$R' = \frac{dT(t)}{dt}$$

is determined.

In this expression, R' expresses the rate by which the profile changes. This rate R' is compared to a threshold, herein referred to as an initial threshold, and a transition between two profiles is considered detected if the threshold is exceeded, i.e. when R' exceeds the initial threshold.

If the substance contained in the compartment has one single phase change temperature, that phase change temperature may define one single transition. The compartment may, however, contain different substances, or substances constituting a blend of components, with different phase change temperature. In that example, the transition could be determined as a convolution between the phase change temperatures of the substances or components.

The first cooling unit may comprise a fan, herein referred to as "a first fan". This fan may be arranged for creating a forced flow of air across the first evaporator and into the compartment where the fan may create a flow of air over the substance to be cooled.

Also, the second cooling unit may comprise a fan, herein referred to as "a second fan". The second fan is arranged for creating a forced flow of air across the second evaporator and into the compartment where the fan may create a flow of air over the substance to be cooled. The second fan may particularly constitute that part of the second cooling unit being activated in the second mode of operation.

The first mode of operation may include operating the entire first cooling unit including the first evaporator and the first fan for reducing the temperature in the compartment. This could be referred to as a normal mode of operation.

Based on the point in time where the transition occurs, the controller may change to either the second or the third mode of operation.

If changing to the second mode of operation only a part of the second cooling unit is initiated. That part could, as stated above be the second fan.

Particularly, the second fan may be the only part of the second cooling unit which is operated in the second mode of operation.

The flow of air created by the second fan may increase the cooling transfer coefficient of air to the substance in the compartment. The increased flow thereby facilitates a faster freezing, i.e. phase change of the substance. When the substance is frozen, i.e. solidified, it may be desirable to change to the first mode of operation, and if it takes too long time to freeze the substance, it may be desirable to change to the third mode of operation and initiate use of all parts of the second cooling unit or keep operating in the second mode of operation.

Accordingly, it may be desirable to determine a point in time where the shift to the third mode of operation or to the first mode of operation. Particularly, this point in time may be based on the further temperature development in the compartment.

The Second Mode of Operation May be Terminated e.g.

based on a specific duration, or based on a specific temperature, or upon identifying a transition between the second temperature profile and a third temperature profile in the compartment.

The third temperature profile may relate to cooling of the frozen substance, i.e. after the solidification is ended.

The transition between the second temperature profile and the third temperature profile could be determined by recording the temperature in the compartment with respect to time, or the transition between the second temperature profile and the third temperature profile could be determined based on knowledge about the substance or based on historical data related to the temperature development for a specific substance.

If the phase change temperature, as an example, is minus 50° C. (air temperature Ta), then a temperature calculated based on this temperature can be used as a transition between the second and the third temperature profiles. In one example, the second mode of operation could be terminated e.g. at minus 55° C. if the phase change temperature is minus 50° C.

The analytical method of determining the transition between the second and the third temperature profiles may be carried out in different ways.

In one example, said rate by which R changes, i.e.

$$R' = \frac{dR}{dt}$$

is determined.

Once again, this rate R' could be compared to a threshold, herein referred to as a termination threshold, and a transition between second profile and the third profile may be considered as detected if R' becomes lower than the termination threshold.

Normally, defrosting is initiated according to a fixed schedule, e.g. every 24 hours etc. To optimize defrosting and reduce operation costs, a defrosting schedule may be determined, based on a differential temperature over the first evaporator. The differential temperature may either be the difference of air temperature or difference in temperature of the refrigerant over the evaporator. A defrosting mode of operation may be initiated based on the schedule.

The defrosting mode of operation may include operating the second cooling unit. As an example, the first cooling unit may be defrosted while the second cooling unit is operated to maintain the temperature in the compartment.

The defrosting schedule may therefore be determined to avoid the defrosting mode of operation in the second mode of operation or in the third mode of operation. I.e. when the second cooling unit or parts thereof are needed to freeze the substance, the defrosting is avoided.

The method may prioritize freezing of the substance over defrosting of the cooling unit. Accordingly, the method may comprise shifting from the defrosting mode of operation to the second mode of operation or to the third mode of operation upon reaching the transition between the first temperature profile and the second temperature profile in the compartment. In that case, defrosting is terminated while the substance change phase.

The method may also comprise shifting from the defrosting mode of operation to the first mode of operation when defrosting is ended. I.e. if the substance is not about to change phase, the defrosting may be followed by normal operation.

The method may also comprise shifting from the second or third mode of operation to the defrosting mode of operation upon reaching the transition between the second temperature profile and the third temperature profile in the compartment while being in the defrosting mode of operation. I.e. when the substance is frozen and the additional cooling capacity for freezing the substance is no longer needed, the controller may shift to defrost mode of operation.

The second mode of operation may be initiated after the cooling of stored substance ends and freezing of substance begin, i.e. when the transition is identified, or it may be initiated at a specific point in time prior to or after the point in time where the transition takes place.

Controlling defrost triggering as described above ensures that when phase change of the substance is starting or is happening, the evaporator/s is/are ice free, providing highest cooling capacity and combined with changing to the other operation modes, the time necessary to reduce the temperature of the substance to the storage temperature is shortest.

When following the analytic approach of recording temperature as a function of time, the transition from the first to the second temperature profile or from the second to the third temperature profile is determined after it occurred. Accordingly, the corresponding shift to the second or third modes of operation will take place after the transition occurred. To initiate the second mode or the third mode of operation prior to the transition requires that the time interval where the transition takes place is predetermined. In one example, it may be determined in a process of freezing a previous batch, by knowledge about the freezing temperature of the substance in the compartment, or by tests, data analysis and correlation between air temperature, cooling system parameters and stored substance temperature.

The method may comprise in storing data on complete temperature profiles (starting from initial temperature to final temperature) and based on real time data analysis determine and/or predict time when phase change of the stored substance may happen and prepare the unit for running optimal ensuring shortest cooling time. The information related to the transition could be either the time it takes to reach the transition, or it could be the temperature where the transition occurs, or it could be both the time and temperature.

From the transition between the first temperature profile and the second temperature profile, a mass identifier may be calculated. The mass identifier identifies an amount of the substance being stored in the compartment and thereby indicates the physical loading of the storage.

The mass identifier may be calculated based on a duration of the transition.

In one embodiment, the method includes determining a suitable point in time to defrost the first or the second evaporator. Below, this is explained relative to the first evaporator, but the method may apply equally to the second evaporator.

The method comprises monitoring over time when the first cooling unit is used, i.e. when it actively contributes to the cooling. This is referred to herein as on-time or on-interval.

As mentioned previously, this could be when the first compressor is on, or when the refrigerant is directed into the first evaporator. Based on this monitoring, a set of first time intervals are determined such that the first time intervals are intervals in which the first cooling unit is used.

The method may include monitoring an air temperature across the first evaporator and thereby a variation in a calculated air cooling capacity provided by the first evaporator.

A cumulative increase of cooling capacity can be determined based on the first time intervals and the air temperature. Finally, the cumulative increase may form the basis for a defrost schedule. This may particularly include defining a threshold value, and comparing the cumulative increase of cooling capacity with the threshold. When the cumulative increase of cooling capacity exceeds a certain percentage of the threshold, it triggers defrosting of the first evaporator. The cumulative increase could be found by the equation:

$$Dfr_{trigger}(i) = \sum_{i=1}^{n} \frac{Q(i) - Q(i-1)}{Qt} + Dfr_{trigger}(i-1)$$

Where Dfr_trigger(i) is the defrost trigger value at the end of a current one of the first time intervals, i.e. ON time interval.

Q(i) is the current interval air cooling capacity, calculated based on air temperature difference across the evaporator as average value for the ON interval;

Q(i−1) is the previous interval air cooling capacity calculated based on air temperature difference across the evaporator Q(t) is the baseline air cooling capacity of the ice free evaporator.

FIGS. 10-12, illustrate the cooling capacity average, the on time, and the cumulative increase in cooling capacity.

As mentioned, the same may apply equally to the second evaporator whereby the method comprises monitoring over time when the second cooling unit is used, i.e. when it actively contributes to the cooling. Based on this monitoring, a set of second time intervals are determined such that the second time intervals are intervals in which the second cooling unit is used. A second cumulative increase of cooling capacity can be determined based on the second time intervals and the air temperature across the second evaporator, and when the second cumulative increase exceeds a certain percentage of the threshold, it is time to defrost the second evaporator.

In a Second Aspect, the Disclosure Provides a Cold Storage Comprising:

a compartment;

a first cooling unit comprising a first circuit for circulating a first refrigerant between a first compressor unit, a first condenser, a first evaporator, a first fan for creating a forced flow of air across the first evaporator, and a first controller operable to control the first compressor unit, a flow of the first refrigerant through the first evaporator, and the first fan; and a second cooling unit comprising a second circuit for circulating a second refrigerant between a second compressor unit, a second condenser, a second evaporator, a second fan for creating a forced flow of air across the second evaporator, and a second controller operable to control the second system/cooling unit, a flow of the second refrigerant through the second evaporator, and the second fan.

The first and second cooling units are independently operable, and both arranged for cooling the compartment.

The independent operation of the first and second cooling units means that parts of one of the cooling unit or the entire cooling unit can be controlled irrespective of the status of the other cooling unit, i.e. whether the other cooling unit is operated or not.

Accordingly, the cold storage facilitates the method according to the first aspect of the disclosure.

The independent operation of the first and second cooling units may be handled by one controller, or by two separate controllers connected individually to each cooling unit.

The Cold Storage May Comprise a Coordinating Controller Configured to:

- operate the first and the second controller in accordance with a first mode of operation and a second mode of operation, the second mode of operation being distinguished from the first mode of operation by use of the second fan,
- identify a transition between a first temperature profile and a second temperature profile in the compartment; and
- initiate operation in accordance with the second mode of operation based on a time interval where the transition is identified.

The coordinating controller may be configured to record a temperature as a function of time in the compartment and to identify the transition between the first temperature profile and the second temperature profile in the compartment based on the recorded temperature.

The controller might allow user operable input means for initiating recording of temperature as a function of time. In one example, the user may initiate by a machine interface that a bulk of substance is introduced into the compartment, and thereby updating the coordinating controller about a coming reach of a phase change temperature thereby triggering the transition between the first temperature profile and the second temperature profile in the compartment.

The machine interface may allow the user also to state an amount of the substance being stored. This information may be used by the coordinating controller to predict when the transition between a first temperature profile and a second temperature profile in the compartment can be expected.

The cold storage may comprise control means configured for determining a defrosting schedule based on a differential temperature over the first evaporator and initiate defrosting based on the schedule while operating the second evaporator and the second fan.

Each of the first and second controllers operate independently on each other, and additionally, each of the first and second controllers may be configured to operate autonomously. Herein, that means without communication between cooling unit controllers and optionally also without communication with the additional coordinating controller. For this purpose, the first and second controllers may be independently powered, and independently provided with control signals e.g. from temperature sensors in the compartment. Accordingly, the second cooling unit may automatically and autonomously initiate operation if the temperature in the compartment reaches a temperature threshold.

The control means may form part of the coordinating controller, the first controller and/or the second controller.

In one embodiment, each of the first and second controllers are configured independently to determine a defrosting schedule for the associated evaporator. Particularly, each of the first and second controllers may be configured to determine such a defrosting schedule based on a differential temperature over the associated evaporator and to initiate a defrosting based on the schedule. When one of the first or second controller initiate defrosting, it may be detected by the other one, initiate cooling to replace the cooling which is lost during the defrosting.

The control means may ensure that defrosting is not initiated when operating the cold storage in accordance with the second mode of operation, or that the evaporators have been previously defrosted and while running in second mode of operation the evaporators are free of ice.

The first and second cooling units may be powered independently, and the first and second cooling units may have separate communication channels, e.g. for data communication with an operator or for temperature monitoring in the compartment.

The cold storage may include memory means for storing information related to the phase change or temperature profile transition used for determining the point in time of initiation of the second mode of operation.

The controller(s) and/the coordinating controller may be implemented in one or more CPUs with memory and computer executable code for enabling various functions according to the method of the first aspect.

The CPUs could form part of a dedicated computer or a standard computer system, e.g. a PC. The controllers may comprise a data interface for communication of data externally, e.g. for exporting results and for importing settings related to the temperature Those skilled in the art will appreciate that the functions of the cold storage may be implemented using standard hardware circuits, using software programs and data in conjunction with a suitably programmed digital microprocessor or general-purpose computer, and/or using applications specific integrated circuitry, and/or using one or more digital signal processors. Software program instructions and data may be stored on a non-transitory, computer-readable storage medium, and when the instructions are executed by a computer or other suitable processor control, the computer or processor performs the functions associated with those instructions.

LIST OF DRAWINGS

FIGS. 1*a* and 1*b* illustrate a cold storage according to the disclosure;

DETAILED DESCRIPTION OF EMBODIMENTS

The detailed description and specific examples, while indicating embodiments of the disclosure, are given by way of illustration only, since various changes and modifications within the spirit and scope of the disclosure will become apparent to those skilled in the art from this detailed description.

Figure 1A:
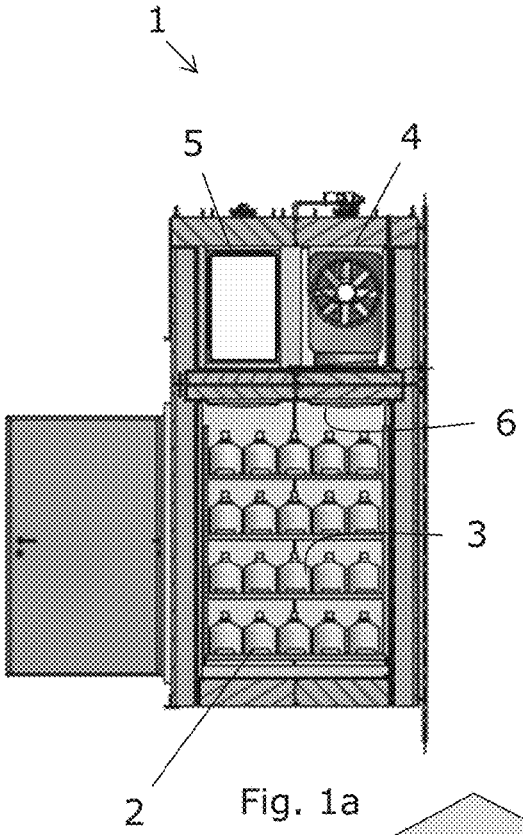
Figure 1B:
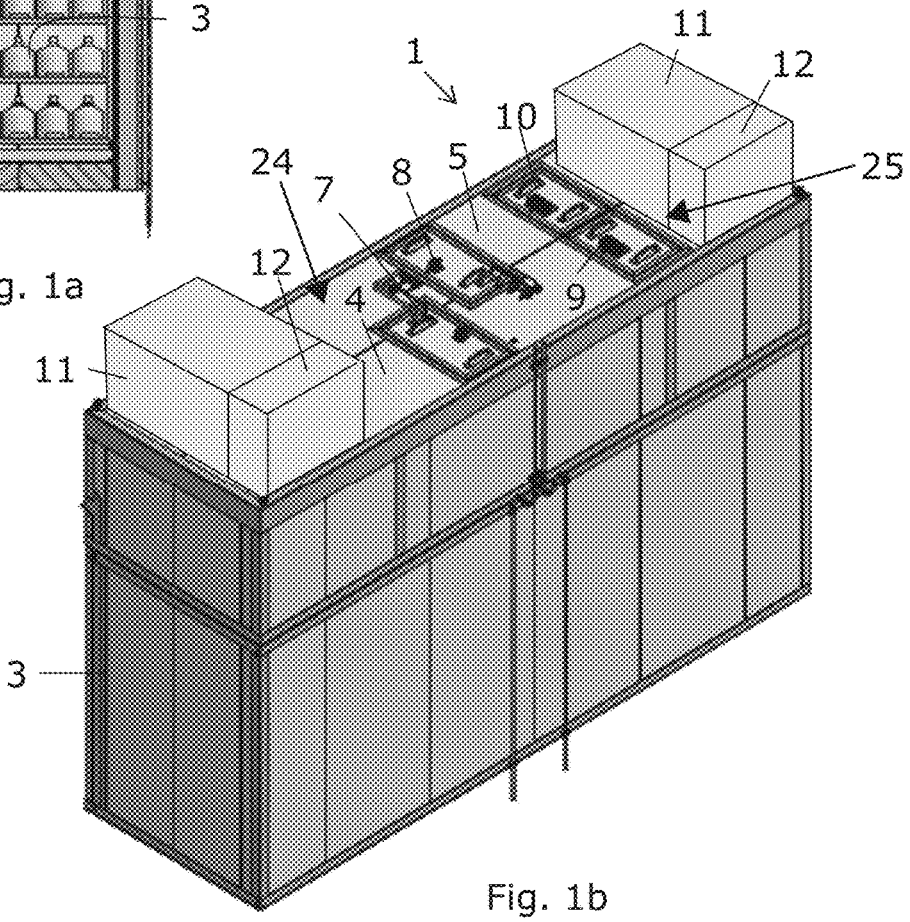

FIGS. 1*a* and 1*b* illustrate a cold storage 1 comprising a compartment 2. The compartment forms a space with thermally insulated walls. It may be formed e.g. by a container, particularly a container for intermodal transport. The illustrated cold storage is made for ultra low temperatures, particularly below minus 70° C. or even below minus 110° C., and serves to freeze medical substances 3, e.g. vaccine.

The cold storage comprises a first cooling unit 24 and a second cooling unit 25. Each cooling unit operates independent on the other cooling unit and thereby provides redundant operation and ensures cooling if one cooling unit is not in operation.

The first cooling unit 24 comprises a first evaporator unit 4 and the second cooling unit 25 comprises a second evaporator unit 5. The evaporator units are located above the compartment. Each evaporator unit forms a duct extending between inlets into the compartment and outlets from the compartment. The inlet and outlet are formed in the ceiling 6 inside the compartment.

A first evaporator 7 is located in the first evaporator unit 4, and a second evaporator 8 is located in the second evaporator unit 5. The evaporators are illustrated in further details in FIGS. 7 and 8.

The evaporator units are located side by side vertically above the ceiling of the compartment 2.

Figure 2:
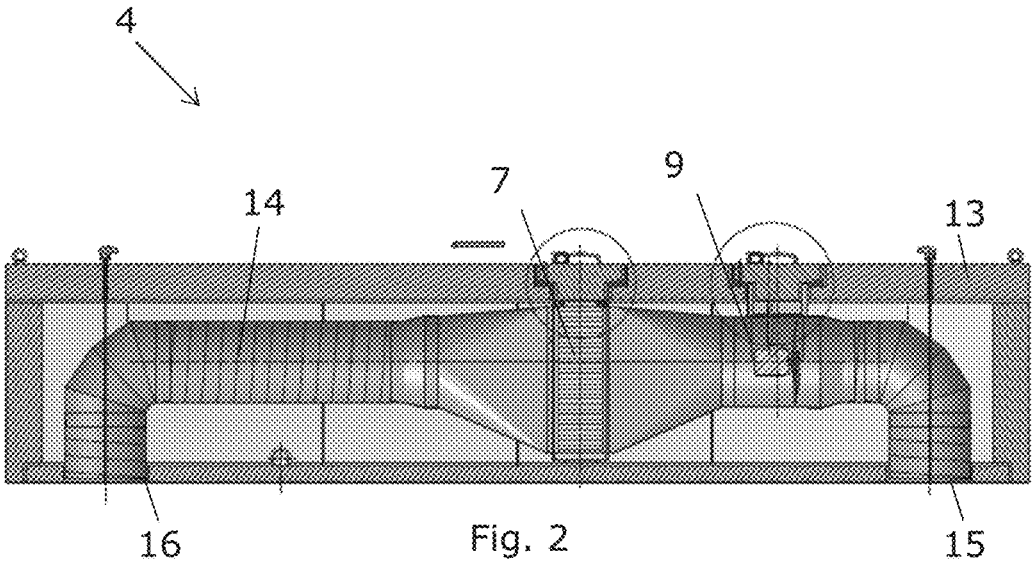
FIGS. 2-4 illustrate evaporator units of the cooling units for the cold storage.

A first fan 9 is located in the duct of the first evaporator unit 4, and a second fan 10 is located in the duct of the second evaporator unit 5. The fans are illustrated in further details in FIGS. 5 and 6. The fans are configured for creating a forced air flow from the inlet 15 to the outlet 16 (c.f. FIG. 2) across the evaporator. The flow of air provides a flow around the substance 3 in the compartment 2.

The first cooling unit 24 further comprises a first compressor unit, and the second cooling unit 25 further comprises a second compressor unit. The compressor units are located outside the compartment, e.g. above the evaporator unit or elsewhere.

The first and second compressor units are illustrated schematically in FIGS. 1*a* and 1*b*, as a box 11. Each compressor unit may comprise one or more compressors connected in different ways known per se, inter alia in cascade/and/or staged/and/or in parallel etc.

The first cooling unit 24 further comprises a first condenser and a first circuit for circulating a first refrigerant between the first compressor unit, the first condenser and the first evaporator.

The second cooling unit 25 further comprises a second condenser and a second circuit for circulating the second refrigerant between the second compressor unit, the second condenser and the second evaporator.

Additionally, each cooling unit 24, 25 comprises an electronic computer system forming a controller operable to control the compressor unit, or to control a flow of the first refrigerant through the evaporator, e.g. by controlling one or more expansion valves. The controller also controls the fan. Each controller is included in one of the illustrated boxes 12.

Each of the two computer systems is completely independent on the other computer system, and the first and second cooling units 24, 25 may therefore operate independently. If one unit is out of order or is being serviced, the other cooling unit is independently operable, and since they are both arranged for cooling the same compartment, the temperature in the compartment may be preserved during malfunction or service.

The two cooling units 24, 25 may have separate power supply to ensure independent operation, i.e. if the power supply of one unit fails, the power supply of the second unit may continue and keep the second unit in operation irrespective of a fault in the first unit. Such a safety feature may ensure constant cooling and may be required e.g. for freezing temperature sensitive products such as medicine etc.

Each duct is individually controllable by a controller housed in a closed space. Upon replacement of an evaporator unit, the control unit is replaced with the ducts and correct functioning and adjustment of the ducts can therefore be ensured. The control unit is illustrated schematically with box 12 in FIG. 1*b*. Or alternatively, it could be placed in control box 12 as an interchangeable module. It may include a computer unit and suitable software and storage capacity for storing data. The control unit may control the cooling function including a flow of refrigerant to the heat exchanger, the speed of the fan, and various monitoring functions including data acquisition for documentation purpose.

Figure 3:
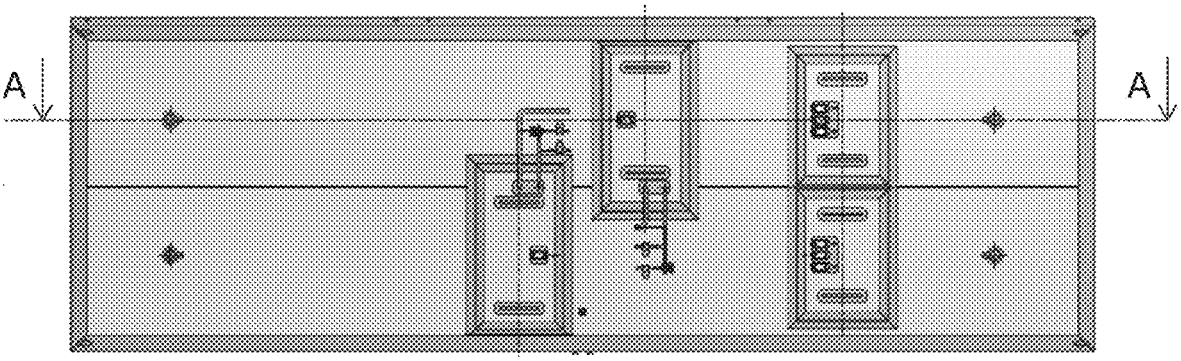
Figure 4:
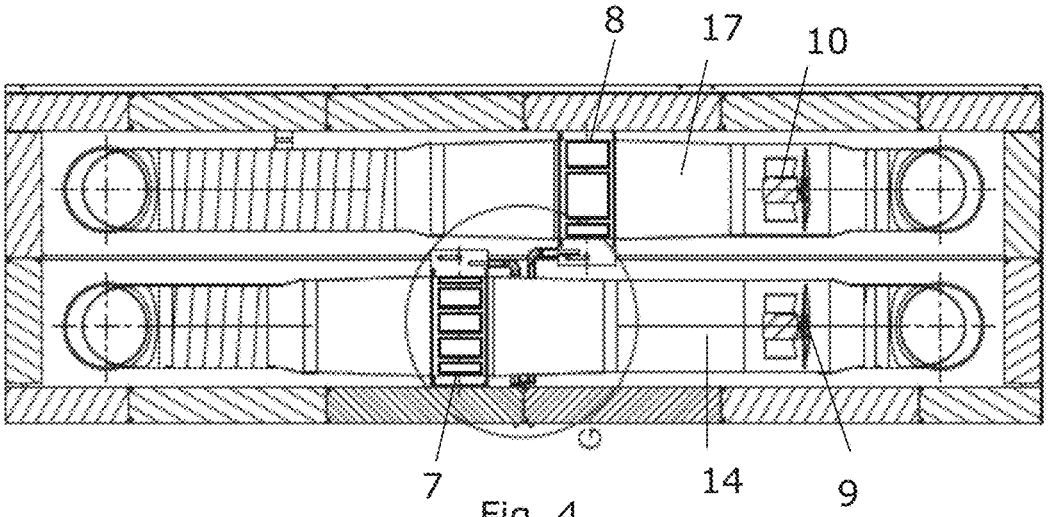

FIG. 2-4 illustrates further details of the evaporator ducts. FIG. 2 illustrates a sideview corresponding to the cross-section along line-AA in FIG. 3. FIG. 4 illustrates top view of the evaporator units. Particularly, FIGS. 2-4 illustrates that the evaporator unit is made as a separate housing 13 which is removably attached to the compartment. The duct 14 forms an inlet 15 from the compartment and an outlet 16 extend into the compartment.

FIG. 4 illustrates the second duct 17 of the second evaporator unit 5.

Figure 5:
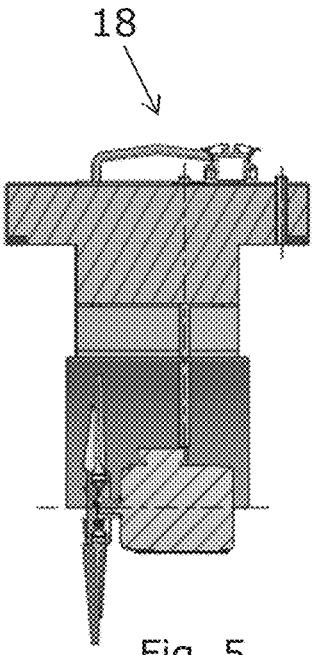
FIGS. 5-8 illustrate removable fan and heat exchanger units for the cooling unit.
Figure 6:
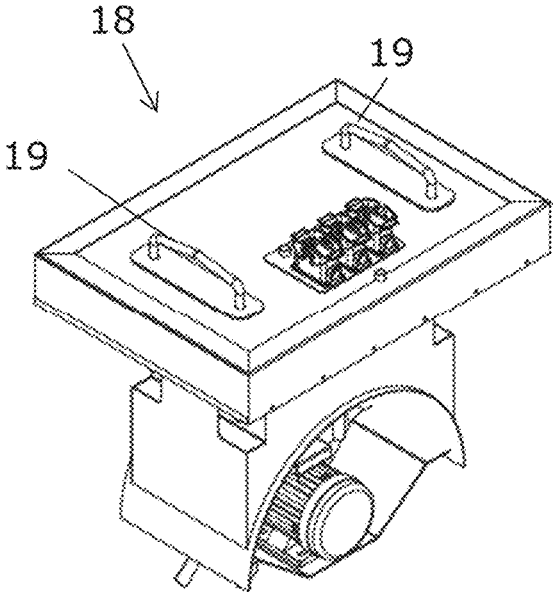
Figure 7:
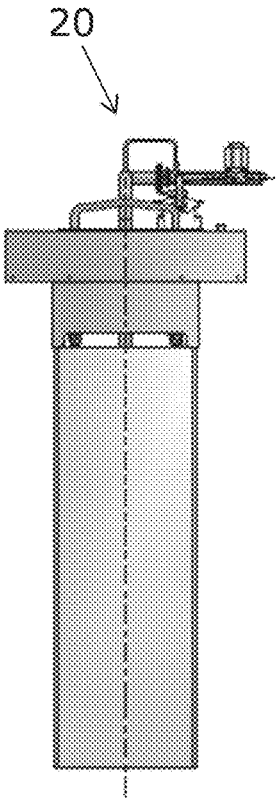
Figure 8:
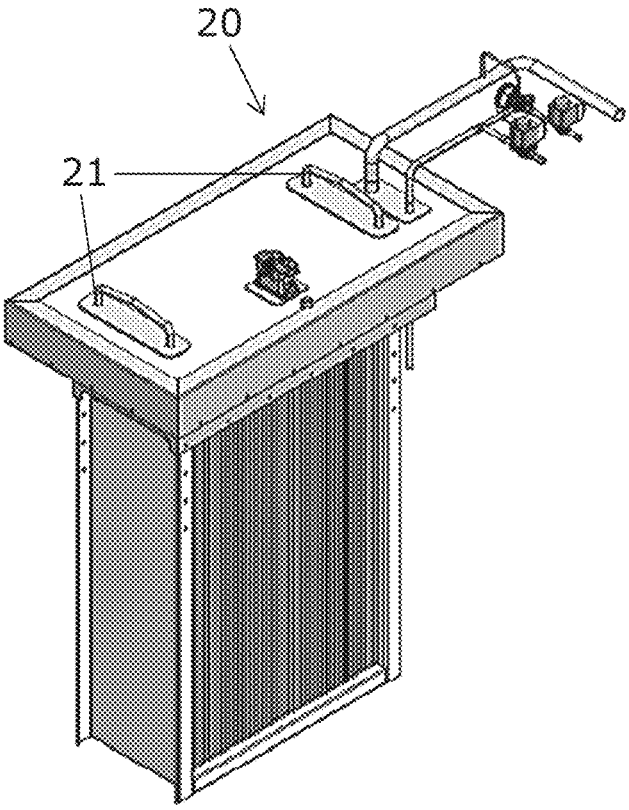

FIGS. 5-6 illustrate a fan unit 18 with handles 19 by which the fan unit can be lifted out of the duct and replaced or repaired. FIG. 7-8 illustrates a heat exchanger unit 20 which includes an evaporator for a compressor-based refrigeration system and provided with handles 21 by which the heat exchanger unit can be lifted out of the duct and replaced, cleaned, or repaired.

The fan and heat exchanger units are both inserted into and removable out of the upper panel thereby allowing easy access to replacement without having to enter the low temperature space. The use of insertable units thereby further increases the ability to maintain the cold storage operational and the ability of preventing temperature fluctuation. In use, the temperature in the compartment can be maintained by use of one or both ducts. In case of faults or in case of maintenance work, one of the ducts can be shut-off and the fan and/or the heat exchanger be removed for cleaning or repair. Should it be necessary to stop operation of both ducts simultaneously, the cooling unit can be taken of the container/room and new evaporator unit can be attached. This ensures continuous operation even when larger repair or maintenance work is required.

The fans are controllable to provide a variable flow. In one embodiment, each fan comprises a rotor in a stator having a first and a second coil set to thereby enable two discrete modes of operation. In another embodiment the fans frequency controlled via a converter to provide a stepwise or continuously variable flow.

Figure 9:
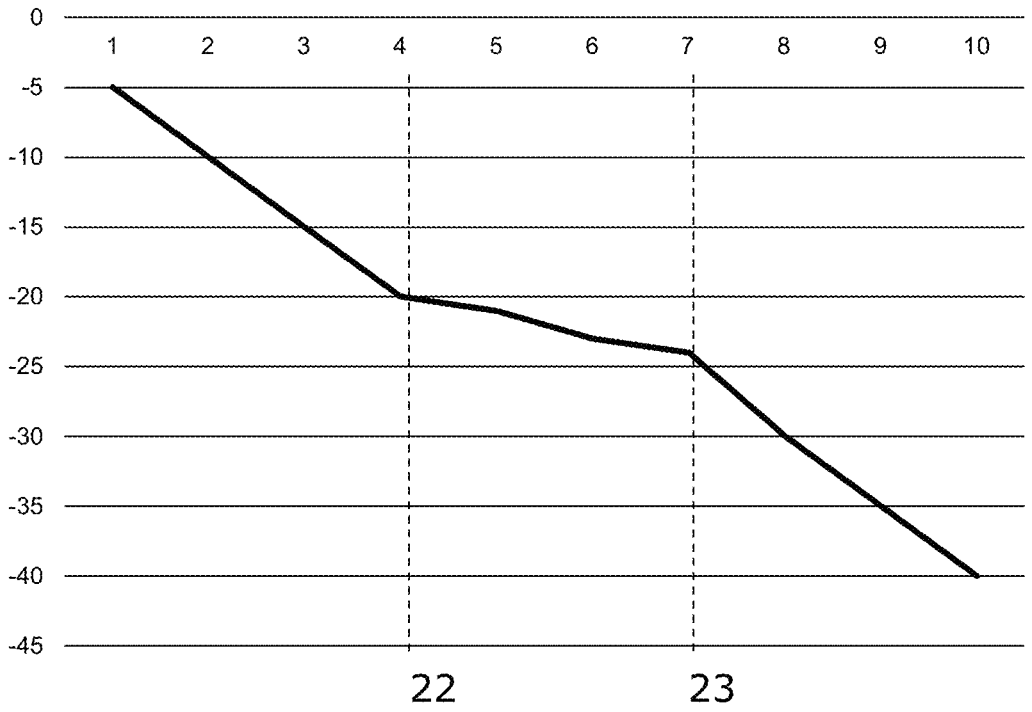
FIG. 9 illustrates temperature development in the compartment.

FIG. 9 illustrates a temperature profile in a coordinate system illustrating elapsed time e.g. in hours, on the abscissa and temperature (in degree Celsius) on the ordinate. The graph has been found by recording temperature in the storage compartment as a function of time, and it illustrates three different temperature profiles identifiable by the slope change at the dotted lines 22 and 23.

In the first temperature profile, i.e. from time=1 to time=4, the temperature develops from minus 5° C. to minus 20° C. The change of temperature in time forms a curve, easily approximated with a linear function. At the transition between the first temperature profile and the second temperature profile, illustrated by the dotted line 22, the temperature profile is different, i.e. the temperature decreases less. The change of temperature in time is still approximated with a linear function but with a decreased slope.

The transition could be caused by a phase change of a substance, particularly freezing defined as a phase change where a liquid starts to solidify when its temperature is equal or lower than its freezing point. The second temperature profile is defined during the phase change time. The second temperature profile is illustrated between the two dotted lines 22, 23.

The point in time where the second mode of operation is initiated can be determined based on the transition of the first temperature profile to the second temperature profile. When shifting to the second mode of operation, not only the first cooling unit but also at least a part of the second cooling unit is used, particularly the second fan. In one embodiment, the second mode of operation is initiated at the point of the transition, i.e. in the illustrated example at time=4. It could also be initiated based on a model defining an offset from the time=4.

In one example, the transition is determined based on knowledge about the substance, or based on recorded air temperature in the compartment as a function of time when the phase change of the stored substance is staring. Subsequently, i.e. freezing of subsequent batches of the substance, the knowledge about the transition can be used for shifting to the second mode of operation after a predetermined or predicted time of reaching the transition.

Following the example illustrated by FIG. 9, knowledge about the substance and/or a first set of recorded temperatures during freezing of the substance may determine the transition to be at minus 20° C. In the process of freezing subsequent batches of the substance, the second mode of operation can be initiated e.g. at minus 15 Celsius or minus 18° C., and the initiated part of the second cooling unit may be operational before the transition is reached.

The dotted line 23 illustrates a transition between the second temperature profile and a third temperature profile. The transition may result from the freezing process, i.e. the solidification of the liquid substance or liquid content in the substance being completed. In response, the temperature drops faster, which can be identified from the dependency of change in temperature during a time interval.

The second mode of operation may be terminated upon expiry of the time interval in which the cold storage has been operated in the second mode of operation, or it may be terminated upon identifying the transition between the second temperature profile and the third temperature profile in the compartment.

The transition between the different temperature profiles can be identified by several mathematic methods considered as standard methods for the skilled persons. An example could be to use the first derivative of the curve and identify a change above a threshold.

Figure 10:
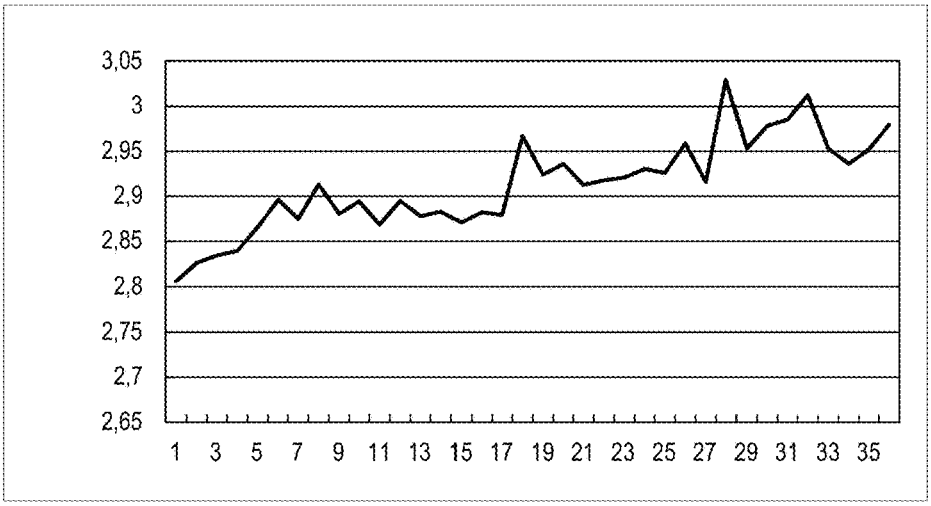
FIGS. 10-12 illustrate Cooling capacity, on time, and cumulative cooling capacity.
Figure 11:
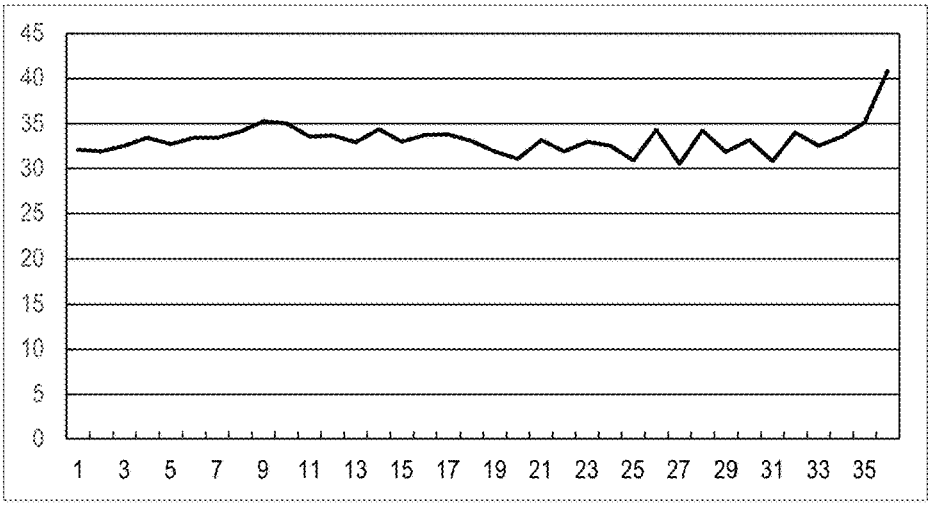
Figure 12:
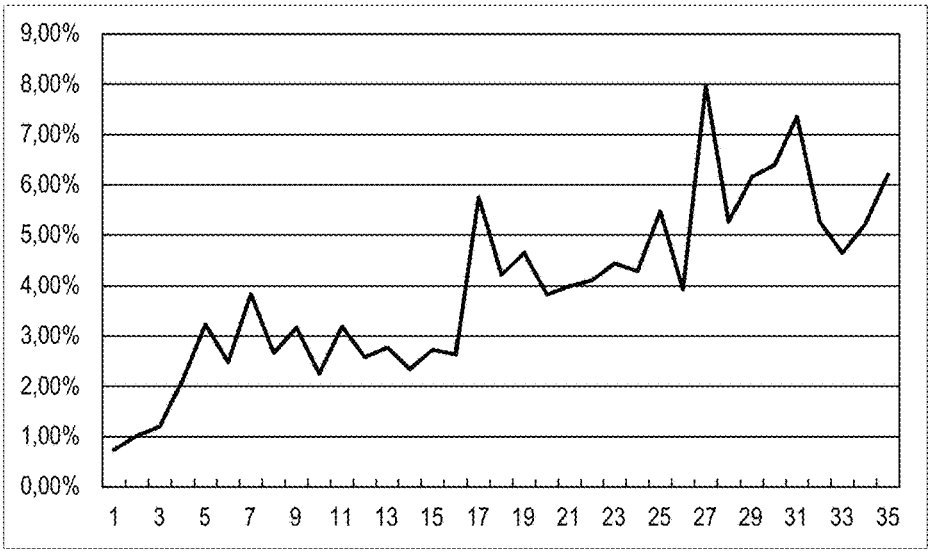

FIGS. 10-12 illustrate monitoring of the first cooling unit. This is taken as an example, and it may just as well be monitoring of the second cooling unit.

FIG. 10 illustrates cooling capacity as a function of average on time intervals, i.e. on the abscissa, it illustrates on time interval number. This is an interval number in said first set of intervals being where the first cooling unit is turned on an contributes to the cooling of the compartment. Along the ordinate it illustrates the evaporator air cooling capacity Q measured in kilowatt.

FIG. 11 illustrates on time duration as a function of on time interval number.

On the abscissa, FIG. 11 illustrates an interval number in said first set of intervals being where the first cooling unit is turned on an contributes to the cooling of the compartment.

Along the ordinate, it illustrates the minutes in which one of the first or second cooling units are used for actively cooling the compartment, referred to herein as on-time. This could e.g. be when the corresponding compressor is turned on, or at least when the controlling valve is open and allows refrigerant to enter the corresponding evaporator. The unit of the ordinate is minutes.

FIG. 12 illustrates the cumulative cooling capacity as a function of the number of the on-time interval.

On the abscissa, FIG. 12 illustrates an interval number in said first set of intervals being where the first cooling unit is turned on an contributes to the cooling of the compartment.

Along the ordinate FIG. 12 illustrates the cumulative cooling capacity Q in percentage. The cumulative cooling capacity is found by the equation:

$$Dfr_{trigger}(i) = \sum_{i=1}^{n} \frac{Q(i) - Q(i-1)}{Qt} + Dfr_{trigger}(i-1)$$

This cumulative cooling capacity is compared with a threshold and based thereon, it is determined when to defrost.

All of the above is explained relative to the first cooling unit, and it may apply equally to the second cooling unit.

The invention claimed is:

1. A method of operating a cold storage comprising a compartment, a first cooling unit arranged to cool the compartment, and a second cooling unit arranged to cool the compartment, the first cooling unit comprising a first circuit for circulating a first refrigerant between a first compressor unit, a first condenser and a first evaporator and the second cooling unit comprising a second circuit for circulating a second refrigerant between a second compressor unit, a second condenser, and a second evaporator, the second cooling unit further comprising a second fan, the cold storage further comprises a controller configured for operating the first cooling unit and the second cooling unit according to a first, a second, and a third mode of operation, the first mode providing use of only the first cooling unit, the second mode of operation providing use of the first cooling unit and the second fan of the second cooling unit, and the third mode of operation provides use of the first cooling unit and the second cooling unit, the method comprising:

operating the cold storage in the first mode of operation;

identifying a transition between a first temperature profile and a second temperature profile in the compartment, the transition being a result of a phase change of a substance stored in the compartment, and the phase change corresponding to a rate of temperature change between the first temperature profile and the second temperature profile; and determining a time for initiating the second mode of operation based on a point in time or a time interval where the transition occurs;

wherein the transition between the first temperature profile and the second temperature profile in the compartment is identified by recording temperature in the compartment in respect of time;

wherein the transition is identified by identifying the rate of temperature development.

2. The method according to claim 1, wherein the transition between the first temperature profile and the second temperature profile in the compartment is determined by identification of the substance.

3. The method according to claim 1, wherein the first cooling unit comprises a first fan for creating a forced flow of air across the first evaporator and the second cooling unit comprises a second fan of the second cooling unit arranged for creating a forced flow of air across the second evaporator, the method comprising operating the first evaporator and the first fan for reducing the temperature in the compartment and initiating operation of the second fan upon determining a phase change of a substance stored in the compartment.

4. The method according to claim 3, wherein the second fan is operated without operating the second evaporator.

5. The method according to claim 1, wherein the second mode of operation is terminated upon identifying a transition between the second temperature profile and a third temperature profile in the compartment.

6. The method according to claim 1, comprising determining a defrosting schedule based on a differential temperature over the first evaporator and initiating a defrosting mode of operation based on the schedule while operating the second evaporator and the second fan.

7. The method according to claim 6, wherein the defrosting schedule is determined to avoid the defrosting mode of operation in the second mode of operation.

8. The method according to claim 6, comprising shifting from the defrosting mode of operation to the second mode of operation upon reaching the transition between the first temperature profile and the second temperature profile in the compartment while being in the defrosting mode of operation.

9. The method according to claim 1, wherein the time for initiating the second mode of operation is determined based on the transition between the first temperature profile and the second temperature profile in the compartment such that the second mode of operation is initiated before reaching the transition.

10. The method according to claim 9, comprising the storing of data related to the transition in a memory storage of a computer system and using said data for controlling the initiation of the second mode of operation.

11. The method according to claim 1, comprising calculating from the transition between the first temperature profile and the second temperature profile, a mass identifier expressing an amount of the substance being stored in the compartment.

12. The method according to claim 11, wherein the mass identifier is calculated based on a duration of the transition.

13. The method according to claim 1, comprising monitoring a set of first time intervals wherein the first cooling unit is used.

14. The method according to claim 1, comprising monitoring an air temperature across the first evaporator and thereby a variation in a calculated air cooling capacity provided by the first evaporator.

15. A cold storage comprising:

a compartment;

a first cooling unit comprising a first circuit for circulating a first refrigerant between a first compressor unit, a first condenser, a first evaporator, a first fan for creating a forced flow of air across the first evaporator; and a second cooling unit comprising a second circuit for circulating a second refrigerant between a second compressor unit, a second condenser, a second evaporator, a second fan for creating a forced flow of air across the second evaporator;

wherein the first and second cooling units are independently operable, and both arranged for cooling the compartment;

the controller comprising hardware circuits using a software program and data in a digital computer, the software program including instructions which, when executed by the computer, perform the method according to claim 1.

* * * * *